United States Patent [19]

Loth et al.

[11] 4,341,530

[45] Jul. 27, 1982

[54] SLURRY ATOMIZER FOR A COAL-FEEDER AND DRYER USED TO PROVIDE COAL AT GASIFIER PRESSURE

[75] Inventors: John L. Loth; William C. Smith; Gary R. Friggens, all of Morgantown, W. Va.

[73] Assignee: The United States of America as represented by the Department of Energy, Washington, D.C.

[21] Appl. No.: 276,610

[22] Filed: Jun. 23, 1981

Related U.S. Application Data

[63] Continuation of Ser. No. 100,663, Dec. 5, 1979, abandoned.

[51] Int. Cl.[3] ..... C10J 3/50

[52] U.S. Cl. ..... 48/73; 48/86 R; 48/DIG. 7; 239/406; 414/291

[58] Field of Search ..... 48/86 R, 73, 77, DIG. 7, 48/202; 414/291; 406/197; 34/10, 57 A; 239/405, 406

[56] References Cited

U.S. PATENT DOCUMENTS

| | | | |
|---|---|---|---|
| 2,089,673 | 8/1937 | Steimmann | 239/405 |
| 4,153,427 | 5/1979 | Bissett et al. | 48/202 |
| 4,165,038 | 8/1979 | Kumazawa | 239/405 |

*Primary Examiner*—Peter F. Kratz

*Attorney, Agent, or Firm*—Earl L. Larcher; Stephen D. Hamel; Richard G. Besha

[57] ABSTRACT

The present invention is directed to a coal-water slurry atomizer for use in a high-pressure dryer employed in a pumping system utilized to feed coal into a pressurized coal gasifier. The slurry atomizer is provided with a venturi, constant area slurry injection conduit, and a plurality of tangentially disposed steam injection ports. Superheated steam is injected into the atomizer through these ports to provide a vortical flow of the steam, which, in turn, shears slurry emerging from the slurry injection conduit. The droplets of slurry are rapidly dispersed in the dryer through the venturi where the water is vaporized from the slurry by the steam prior to deleterious heating of the coal.

3 Claims, 2 Drawing Figures

SLURRY ATOMIZER FOR A COAL-FEEDER AND DRYER USED TO PROVIDE COAL AT GASIFIER PRESSURE

This is a continuation of application Ser. No. 100,663, filed Dec. 5, 1979, now abandoned.

BACKGROUND OF THE INVENTION

The present invention relates generally to a coal-water slurry pumping and drying system for feeding coal to a pressurized coal gasifier, and more particularly to a slurry atomizer for use in such a system for providing slurry droplets of a size capable of being "dried" without excessively heating the coal.

The conversion of the vast coal reserves of the world to usable fuels is becoming of increasing importance in the efforts to satisfy the ever growing energy demands. Coal gasification is a mechanism by which combustible gas may be readily generated for use as an energy source. Several gasification systems are presently utilized for such gas generation and function at pressures ranging from about atmospheric up to about 1500 psia.

In coal gasification systems operating at greater than atmospheric pressure, coal-transferring systems are required for introducing the coal into the high pressure vessel. One such coal-transferring system is a lock-hopper type apparatus formed of a plurality of valved hoppers disposed between the coal bin and the gasifier and includes appropriate valving and hopper-pressurizing systems for increasing the pressure of the coal within a selected hopper to a pressure corresponding to that of the gasifier. Such lock hopper apparatus are somewhat complex and suffer many problems, especially those due to erosion from the coal which considerably detracts from the life of the valves.

The use of pumps to pressurize coal for introduction of it into pressurized gasifiers has not been satisfactory due to the abrasive nature of dry coal which significantly reduces pump life. This erosion problem encountered in pumping coal has been somewhat relieved by mixing the coal with water prior to pumping the resulting slurry to the desired pressure. With the water present in the slurry, the combustion efficiency suffers. However, excess water has been successfully removed from the coal-water slurry by employing the coal-feeding and drying system set forth in assignee's U.S. Pat. No. 4,153,427 entitled "Apparatus and Method for Feeding Coal into a Coal Gasifier," which issued May 8, 1979. In this patented system a coal-water slurry is pumped to the desired pressure and then the water in the slurry is removed prior to the introduction of the coal into the gasifier by contacting the slurry with superheated steam in an entrained bed dryer. The steam is at a temperature sufficient to dry the coal by rapidly vaporizing the water in the slurry. At the exit end of the entrained bed dryer the steam is separated from the coal by employing a simple separator, e.g., a cyclone. The "dried" coal may then be introduced into the gasifier while the steam separated from the slurry may be recycled through a suitable filtering mechanism back into the dryer through a compressor and superheater. The steam, which is superheated to a temperature and is at a flow rate sufficient to vaporize essentially all of the water in the slurry and to superheat the vapor removed from the slurry, is admixed with the slurry at the entrance of the entrained bed dryer to effect the drying of the coal prior to overheating the coal particles which could lead to the agglomeration of the coal and/or to the devolatilization of the coal and the loss of evolved gases. In order to make the patented system function properly it is necessary that the coal slurry be rapidly admixed with the steam while being simultaneously formed into droplets of a size which will permit the necessary rapid drying. Inasmuch as the atomizer of the present invention is to be utilized in the system described and claimed in assignee's aforementioned patent, the patent teachings are incorporated herein by reference.

SUMMARY OF THE INVENTION

Accordingly, it is the primary objective or goal of the present invention to provide a slurry-atomizing nozzle wherein a coal-water slurry and superheated steam can be mixed immediately and thoroughly upon contact to form droplets of the slurry and steam of a desired size to effect vaporization of the water from the droplets prior to deleterious overheating of the coal. In order to accomplish this objective, the entrained bed dryer of assignee's aforementioned patent is provided with a nozzle at the lower end thereof which is defined by a shell or housing in the form of a cylindrical body having an open-ended elongated cavity or chamber in registry with the interior of the coal dryer. A venturi having a throat of a diameter less than that of the cavity is disposed adjacent to the open end of the nozzle and defined by converging and diverging sections. A slurry-conveying pipe or conduit of constant or uniform diameter extends into the cavity from the rear end thereof and terminates at a location adjacent to the venturi throat. An annulus defined by the housing and the cylindrical body is disposed about the body and defines a manifold which is provided with superheated steam. A plurality of passageways penetrate the body to place the manifold in registry with the cavity with each of these passageways having a longitudinal axis disposed tangentially to the longitudinal axis of the cavity for imparting a spiral flow to the steam entering the cavity to form a vortex of steam within the cavity. This vortical flow of steam contacts the stream of slurry discharging from the open end of the pipe and effectively shears the slurry stream at the interface therewith for effecting the formation of the droplets as they are introduced into the dryer. The nozzle of the present invention effectively atomizes the slurry to the extent necessary to provide for the drying of the coal in the coal-bed dryer without subjecting the coal to deleterious overheating.

Other and further objects of the invention will be obvious upon an understanding of the illustrative embodiment about to be described or will be indicated in the appended claims, and various advantages not referred to herein will occur to one skilled in the art upon employment of the invention in practice.

A preferred embodiment of the invention has been chosen for the purpose of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated.

DESCRIPTION OF THE DRAWINGS

In the accompanying drawings.

DETAILED DESCRIPTION OF THE INVENTION

Figure 1:
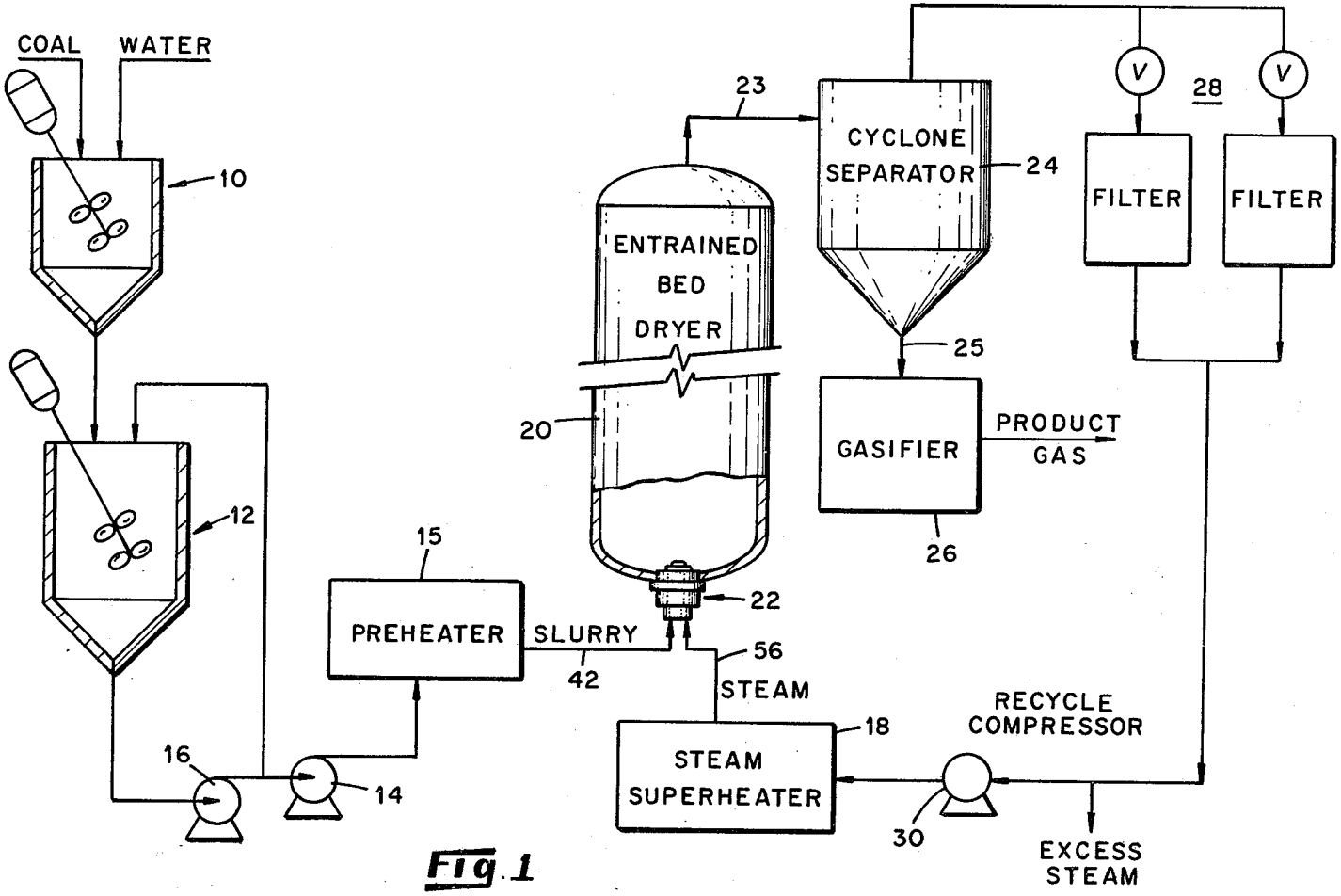
FIG. 1 is a somewhat schematic view of the system described in assignee's aforementioned patent wherein the nozzle of the present invention is utilized for atomizing the coal prior to introduction of the slurry-steam mixture into the entrained bed dryer.
Figure 2:
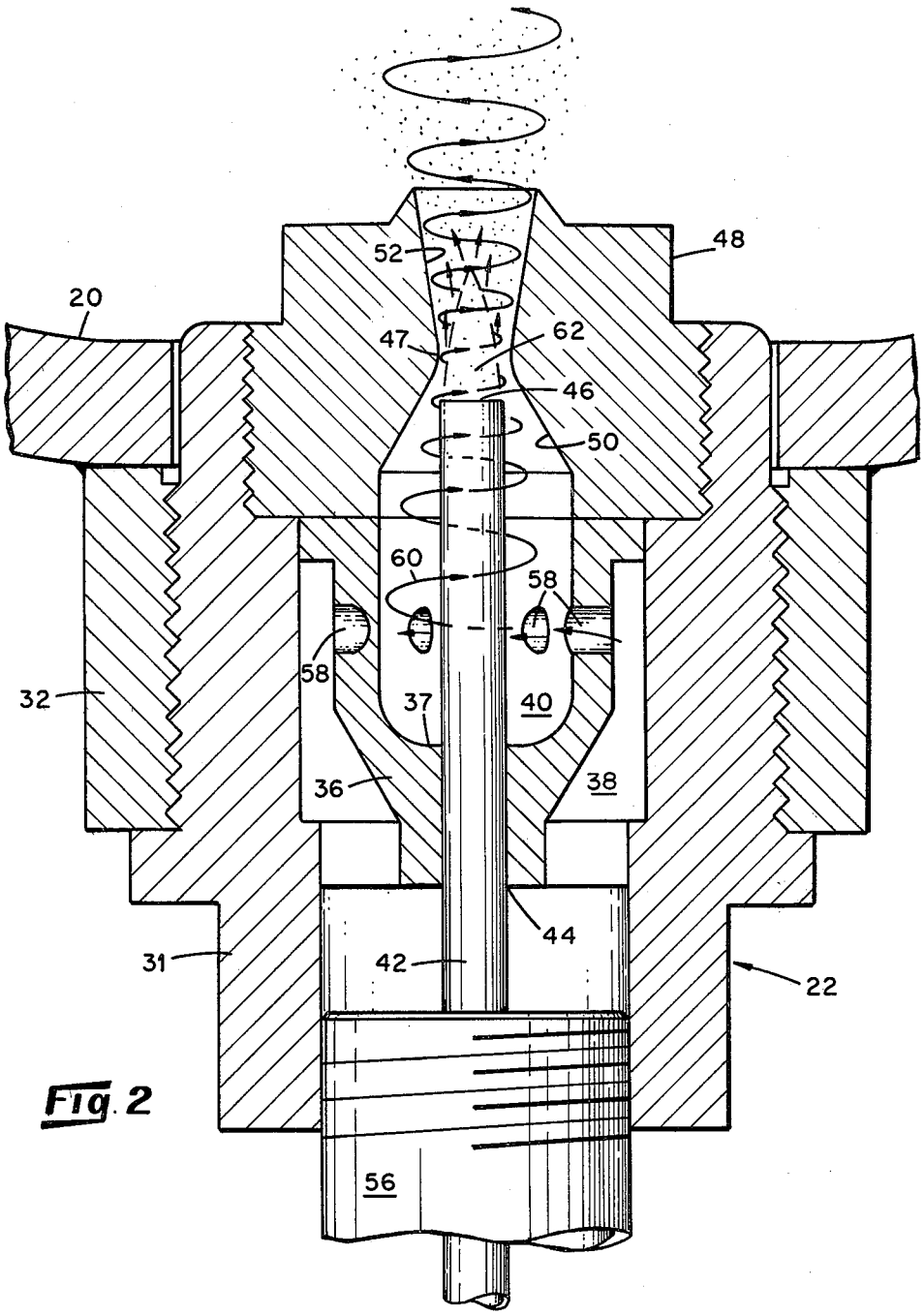
FIG. 2 is a sectional view showing details of the slurry-steam atomizing nozzle of the present invention.

The apparatus utilized for feeding coal into a gas-producer coal gasification system operable at a pressure greater than atmospheric pressure as described in detail in assignee's aforementioned patent and as shown in FIG. 1 generally comprises mixing chambers 10 and 12 wherein a coal-water slurry of about 30 to 70 wt. % water and coal of a particle size of less than about 0.25 inch is formed. The slurry is pumped in a suitable high-pressure pump 14 to a pressure sufficient for introduction into a pressurized gasifier. The slurry may be heated in a preheater 15 for facilitating the vaporization of the water from the slurry. A slurry recirculating system upstream of the pump 14 includes a relatively low-pressure pump 16 for maintaining a suspension of the coal in the slurry. Steam which is heated to a desired temperature in a superheater 18 is introduced concurrently with the slurry into an elongated entrained bed dryer 20. The steam is at a flow rate and temperature sufficient to vaporize essentially all of the water in the slurry upon contact therewith when the slurry is atomized to the desired droplet size as provided by the nozzle of the present invention. This nozzle 22, as will be described in greater detail below, is disposed within the dryer 20 at the lower end thereof where the nozzle receives the coal-water slurry and the steam as separate streams and effects a thorough mixing and atomization thereof. The superheated steam effectively vaporizes the water from the droplets resulting from the atomization. The steam-dried coal and the steam produced from the water vaporized from the droplets are passed out of the dryer through a conduit 23 adjacent the uppermost end of the dryer into a separator 24 where the dried coal is separated from the steam and conveyed through a suitable conduit 27 into the coal gasifier 26. The steam separated from the coal is in turn passed through a suitable filter arrangement 28, a recycle compressor 30, and the superheater 18 for reuse in the dryer 20. Excess water in the form of steam as provided by the vaporization of the water in the slurry is preferably removed from the stream between the steam filters and the compressor. This excess steam may be used in any satisfactory manner such as in the preheater 15 for heating the slurry to approximately 100° F. below the saturation pressure of the slurry.

The nozzle 22 comprises a tubular elongated housing 31 which may be fixed to the dryer 20 by a threaded coupling arrangement generally shown at 32. However, the nozzle 22 may be secured in any satisfactory manner to the dryer. An annular body 36 is secured in the housing 31 and radially spaced from the inner surface thereof to define a manifold or annulus 38. The annular body 36 is closed at the end 37 thereof remote to the dryer 22 to define an elongated steam-receiving chamber 40. An elongated conduit 42 extends into the chamber through a passageway 44 in the end 37 of the annular body 36. This conduit 42 is of constant area and projects into the cavity 40 along the longitudinal axis of the annular body 36. The open end 46 of the conduit 42 terminates at a location near the throat 47 of the venturi assembly 48 which is defined by a converging section 50 and a diverging section 52. The diverging section 52 forms a diffuser which is of a relatively short length so as to inhibit diffusion of the coal slurry emanating from the end 46 of the conduit 42 through the surrounding steam vortex onto the diffuser walls since such wall impingement would promote the formation of larger droplets and thereby decrease the drying efficiency while increasing coal agglomeration.

The open end 46 of the conduit 42 terminates approximately one conduit diameter upstream of the throat 47. The throat 47 is, in turn, of a diameter approximately twice that of the conduit 42. A steam conduit 56 is coupled to the housing 31 and is in open registry with the annulus 38. A plurality of ports or passageways 58 in the annular body 36 place the annulus 38 in registry with the chamber 40. These passageways 58 project through the wall of the annular body 36 along a plane tangentially disposed to the longitudinal axis of the chamber 40. Steam from the annulus 38 flows into the chamber 40 through these passageways 58 to generate a vortex generally shown by the lines 60 in the chamber 40. The injection kinetic energy of the steam equals the enthalpy drop in the passageways which can be computed from a designed pressure drop. The steam flowing into the converging section 50 of the venturi assembly 48 increases in tangential velocity due to the conservation of angular momentum and the static pressure at the venturi throat 47 and is at a pressure below the injection pressure through the passageways 58. The atomization of the slurry generally shown at 62 being ejected from the open end 46 of the conduit 42 is achieved by the vortex 60 or spiral flow of the steam which causes a turbulent viscous shear in the steam-slurry interface. The extensive difference in the velocity between the slurry and the steam vortex is sufficient to provide the atomization energy required. This shear power is defined as $\tau \Delta V A_{shear}$ where the symbol $\tau$ is the average turbulent shear stress; $\Delta V$ is the average velocity difference between the slurry and the steam at the interface; and $A_{shear}$ is the active contact area defined by the conical surface area at the slurry pipe exit 46. This cone formed by the slurry 62 has the slurry pipe exit 46 as the base of the cone and extends downstream to a point where the slurry stream is sheared or peeled off completely so that only droplets of the slurry enter the dryer 20. This shear power is proportional to the shear area $A_s$ and to the velocity difference $\Delta V$ at the interface. The power required for the atomization of the slurry equals the product of droplet surface tension $\sigma$, the droplet area $A_d$, and the number of droplets produced per unit time $\dot{N}$. For a given droplet diameter, the atomization is then proportional to the slurry flow rate which in turn is proportional to the slurry pipe 42 diameter squared. The equation for the aforementioned vortex shear power equaling slurry atomization power is as follows: $\tau \Delta V A_s = \sigma A_d \dot{N}$. The turbulent shear stress $\tau$ is only a weak function of the Reynold's number of flow so that when employing specific steam and slurry injection velocities the same atomized droplet diameter will occur independently of the scale of the nozzle 22. The coal slurry droplets will continue to expand and diffuse externally of the venturi to form a fine mist plume-like flow of droplets with a diameter equal to several venturi exit diameters. The coal slurry 62 will be fully atomized and dispersed within the dryer within one exit diameter of the diverging section 52.

The apparatus of the present invention is designed to provide droplets smaller than 100 micrometers in diameter. However, even with such small droplets due to the absorption of water in the porous surface of the coal, total dryness cannt be realistically achieved. Normally, a coal moisture content of about 2–5% will remain in the coal, but such a quantity of water will not be deleterious for coal conversion processes as contemplated for the present invention.

It will be seen that the nozzle of the present invention provides a slurry atomizing mechanism particularly suitable for use in assignee's aforementioned coal-drying and feeding apparatus to assure that the coal slurry to be dried is adequately reduced to droplets of a size wherein the coal can be dried without being subjected to the aforementioned deleterious overheating problems.

What is claimed is:

1. A coal-water slurry atomizer in combination with an apparatus for feeding coal into gasification means operable at a pressure greater than atmospheric pressure comprising mixing means for forming a slurry of coal and water, pumping means coupled to the mixing means for pumping said slurry to a pressure sufficient for introduction into the gasification means, heating means for providing steam at a temperature and flow rate sufficient to vaporize the water in said slurry, an elongated entrained bed coal dryer, conduit means for separately conveying the slurry and the steam to said dryer adjacent one end thereof, a coal-water slurry atomizer coupled to said conduit means and in registry with said coal dryer for atomizing the slurry in the presence of the steam into droplets of a predetermined size and for discharging the droplets and steam into said dryer to effect evaporation of the water from the slurry without excessively heating the coal to inhibit agglomeration and devolatilization of the coal, means coupled to said dryer adjacent the end thereof opposite said atomizer for separating the coal from said stream, and conduit means for conveying the separated coal into the gasification means, said atomizer consisting of a housing supporting a body affixed to said coal dryer and having an internal open-end elongated cavity therein with the open end of said cavity being in registry with the interior of said dryer, said housing having a converging section and a diverging section disposed adjacent to the open end of the cavity to define a flow-restricting venturi, the conduit means for conveying said slurry includes a portion thereof projecting into said cavity from the end thereof opposite to said open end and extending into said converging section and terminating at a location adjacent to the throat of said venturi, an annulus disposed about the periphery of said body and in registry with the conduit means conveying the steam, a plurality of passageway means disposed about the circumference of said body for placing said annulus in registry with the interior of said cavity, each of said passageway means having a longitudinal axis disposed tangentially to the longitudinal axis of said cavity for imparting a spiral flow to the steam entering the cavity for forming a vortex of steam within the cavity about the slurry conduit means with the flow of steam encompassing and contacting the stream of slurry discharging from the conduit segment for shearing slurry from the slurry stream at the interface thereof to effect the atomization of the slurry, the velocity of said spiral flow of steam being sufficiently increased in said converging section prior to contacting the slurry to a value sufficient to impart said shearing and atomization of said slurry, and said diverging section being of a length sufficient to inhibit impingement of slurry droplets resulting from the atomization of the slurry onto wall surfaces of the housing forming the diverging section prior to the droplets entering the interior of said coal dryer.

2. The coal-water slurry atomizer claimed in claim 1, wherein the conduit means for conveying the slurry is disposed on the longitudinal axis of the cavity in said body and is of constant diameter over the length thereof in said cavity.

3. The coal-water slurry atomizer claimed in claim 2, wherein the venturi throat diameter is about double the diameter of the conduit means for conveying the slurry, and wherein the venturi throat is disposed about one diameter of the conduit means for conveying the slurry downstream from the discharge end of the latter.

* * * * *